US006474588B2

(12) United States Patent
Valverde

(10) Patent No.: US 6,474,588 B2
(45) Date of Patent: Nov. 5, 2002

(54) MOTORIZED RETRACTABLE SKI TOW ROPE

(76) Inventor: Eduardo Valverde, 9523 Riverland La., Houston, TX (US) 77040

( * ) Notice: Subject to any disclaimer, the term of this patent is extended or adjusted under 35 U.S.C. 154(b) by 0 days.

(21) Appl. No.: 09/887,057

(22) Filed: Jun. 25, 2001

(65) Prior Publication Data

US 2002/0005451 A1 Jan. 17, 2002

Related U.S. Application Data

(60) Provisional application No. 60/218,681, filed on Jul. 17, 2000.

(51) Int. Cl.[7] ..... B65H 75/30; B65H 75/40; B63B 21/16

(52) U.S. Cl. ..... 242/390.2; 242/390.8; 242/396.9; 242/904; 114/254

(58) Field of Search ..... 242/390.2, 390.3, 242/390.8, 390.9, 396.5, 396.9, 904; 114/254

(56) References Cited

U.S. PATENT DOCUMENTS

| | | | | | |
|---|---|---|---|---|---|
| 3,034,742 | A | * | 5/1962 | Reynolds | 114/254 |
| 3,156,429 | A | * | 11/1964 | Jones | 242/904 |
| 3,162,395 | A | * | 12/1964 | Bray | 242/904 |
| 3,195,831 | A | * | 7/1965 | Shriner et al. | 242/904 |
| 3,315,914 | A | * | 4/1967 | Turner | 242/904 |
| 3,443,772 | A | * | 5/1969 | Prosser | 242/904 |
| 3,456,891 | A | * | 7/1969 | Parr | 242/904 |
| 3,919,963 | A | * | 11/1975 | Cox | 242/904 |
| 3,964,425 | A | | 6/1976 | Septor, Sr. | |
| 4,098,213 | A | | 7/1978 | McGinnis | 114/254 |
| 4,133,496 | A | | 1/1979 | Zetah | |
| 4,624,141 | A | | 11/1986 | Soleau | 73/865.8 |
| 4,887,777 | A | | 12/1989 | Rasmussen | |
| D334,960 | S | | 4/1993 | Goodman | D21/230 |
| 5,238,200 | A | | 8/1993 | Ritzenthaler | |
| 5,632,219 | A | | 5/1997 | Fleming, Jr. | 114/254 |
| 5,732,648 | A | * | 3/1998 | Aragon | 242/904 |
| 5,762,282 | A | | 6/1998 | Wolner | 242/390.8 |

FOREIGN PATENT DOCUMENTS

| | | |
|---|---|---|
| DE | 003332856 | 3/1985 |

* cited by examiner

*Primary Examiner*—John M. Jillions
(74) *Attorney, Agent, or Firm*—Richard C. Litman

(57) ABSTRACT

A water ski tow rope retrieval and payout system is disclosed. The system includes a reel having a quantity of tow rope wound therearound. The reel is powered by an electric motor through a drive shaft which is also coupled to an electrically controlled brake or clutch. The brake or clutch acts to keep the drive shaft, and thus the reel, from rotating freely when the electric motor is not being used to pay out or retrieve tow rope. An embodiment of the water ski tow rope retrieval and payout system having radio remote control is also disclosed.

4 Claims, 9 Drawing Sheets

MOTORIZED RETRACTABLE SKI TOW ROPE

CROSS-REFERENCE TO RELATED APPLICATION

This application claims the benefit of U.S. Provisional Patent Application Ser. No. 60/218,681, filed Jul. 17, 2000.

BACKGROUND OF THE INVENTION

1. Field of the Invention

The present invention relates to a motorized retractable line for use with a watercraft and intended for towing a water skier or other objects behind the watercraft.

2. Description of Related Art

Water skiing is a popular recreational activity. The skier attaches one or two skis to his or her feet and is then towed behind a power boat or personal watercraft using a water ski tow rope. One end of the tow rope is provided with a handle for the water skier to grasp. As the boat or watercraft, and consequently the skier being towed, gains speed, the ski or skis hydroplane allowing the skier to glide over the surface of the water.

It is often times desirable to vary the length of rope between a water skier and the watercraft towing the water skier. For example, when turning close to shore a shorter rope may be desirable, while a longer length of tow rope may be necessary when making a jump off a ramp. Also, when a water skier falls it would be desirable to retrieve the tow rope to prevent the handle at the end of the tow rope from dragging in the water and possibly causing injury to a fallen water skier. For these reasons, water ski tow rope retrieval systems have been proposed in the art as can be seen from the references cited below. However, none of the references cited below teach or suggest the unique structural features of the present invention. Further, none of the systems discussed in the documents cited below are particularly well suited for use with personal watercraft.

U.S. Pat. No. 5,762,282, issued to J. Thomas Wolner on Jun. 9, 1998, is directed to a retractable lifeline extender having a remote control capability. The Wolner device includes an electric motor for powered payout and retraction of a lifeline to a user located below the device. The device is actuated by a hand-held remote control unit. The Wolner device is intended primarily for tethering workers working on high scaffolds or building structures.

U.S. Pat. No. 5,632,219, issued to David S. Fleming, Jr. on May 27, 1997, is directed to a multiple-spool water ski tow rope retriever. The Fleming, Jr. device includes a motor driven shaft which passes through a plurality of spools. There is a fluid coupling between the shaft and the spools and only spools that are not pulling a water skier get automatically reeled in.

U.S. Pat. No. 5,238,200, issued to Robert Ritzenthaler on Aug. 24, 1993, is directed to a rope winding device having a spool and a drive motor for winding the spool. The Ritzenthaler device also includes a solenoid which functions to selectively move the spool into and out of engagement with the drive motor.

U.S. Pat. No. 4,887,777, issued to Trent T. Rasmussen on Dec. 19, 1989, is directed to an ice fishing device for automatically winding fishing line onto a reel. The apparatus of Rasmussen includes a hand grip connected to one end of a reel shaft, a motor with a rotatable drive shaft connected to the other end of the reel shaft, a projecting trip shaft pin positioned on the drive shaft, a power source connected to the motor, and a push button for actuating the operation of the motor.

U.S. Pat. No. 4,624,141, issued to James R. Soleau on Nov. 25, 1986, is directed to a tow rope handling system for a boat. The system of Soleau is designed to trigger an alarm when a tow rope is released by a water skier. The system of Soleau also includes a reel and a winding mechanism for varying the length of the tow rope extending between the boat and the water skier.

U.S. Pat. No. 4,133,496, issued to Richard H. Zetah on Jan. 9, 1979, is directed to a water ski tow rope retriever. The Zeta device includes a reel and an electric motor which acts to rotate the reel so as to retrieve a water ski tow rope.

U.S. Pat. No. 4,098,213, issued to Lee R. McGinnis on Jul. 4, 1978, is directed to a dual role water ski tow rope retriever. The device of McGinnis includes a reel which is movable between a vertical-axis position and a horizontal-axis position. In its vertical-axis position the reel is rotatable by an electric motor. The horizontal-axis position of the reel allows the paying out of tow rope without the rotation of the reel.

U.S. Pat. No. 3,964,425, issued to Nelson C. Septor, Sr. on Jun. 22, 1976, is directed to a water ski tow rope retracting device. The device of Septor, Sr. includes a reel, which is rotated by a belt and pulley arrangement, and an electric motor which drives the belt and pulley arrangement via a worm gear drive.

U.S. Pat. No. Des. 334,960, issued to David G. Goodman on Apr. 20, 1993, shows the ornamental design for a retractable water ski rope which includes a reel having a quantity of rope wound around the reel.

German Patent Application Number 33 32 856 A1, published on Mar. 28, 1985, is directed to a hose coiling and uncoiling mechanism having a drum around which the hose is wound. The drum drive system is controlled by remote control using a radio transmitter.

Soviet Document Number 397467, published on Sep. 17, 1973, is directed to a power driven reel for winding and unwinding wire in the presence of a high voltage. The reel is operated by remote control.

None of the above inventions and patents, taken either singly or in combination, is seen to describe the instant invention as claimed.

SUMMARY OF THE INVENTION

The present invention is directed to a water ski tow rope retrieval and payout system. The system includes a reel having a quantity of tow rope wound therearound. The reel is powered by an electric motor through a drive shaft which is also coupled to an electrically controlled brake or clutch. The brake or clutch acts to keep the drive shaft, and thus the reel, from rotating freely when the electric motor is not being used to pay out or retrieve tow rope. An embodiment of the water ski tow rope retrieval and payout system having radio remote control is also disclosed. The system of the present invention is particularly well suited for being retrofitted to existing personal watercraft, however, the system of the present invention may also be retrofitted to other types of watercraft or may be built into newly manufactured watercraft of all types.

Accordingly, it is a principal object of the invention to provide a system for powered retrieval and pay-out of a water ski tow rope.

It is another object of the invention to provide a system for powered retrieval and pay-out of a water ski tow rope that is suitable for use on personal watercraft.

It is a further object of the invention to provide a system for powered retrieval and pay-out of a water ski tow rope that can be easily retrofitted to existing watercraft.

Still another object of the invention is to provide a system for powered retrieval and pay-out of a water ski tow rope that can be operated by both the water skier and by the operator of the watercraft towing the water skier.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
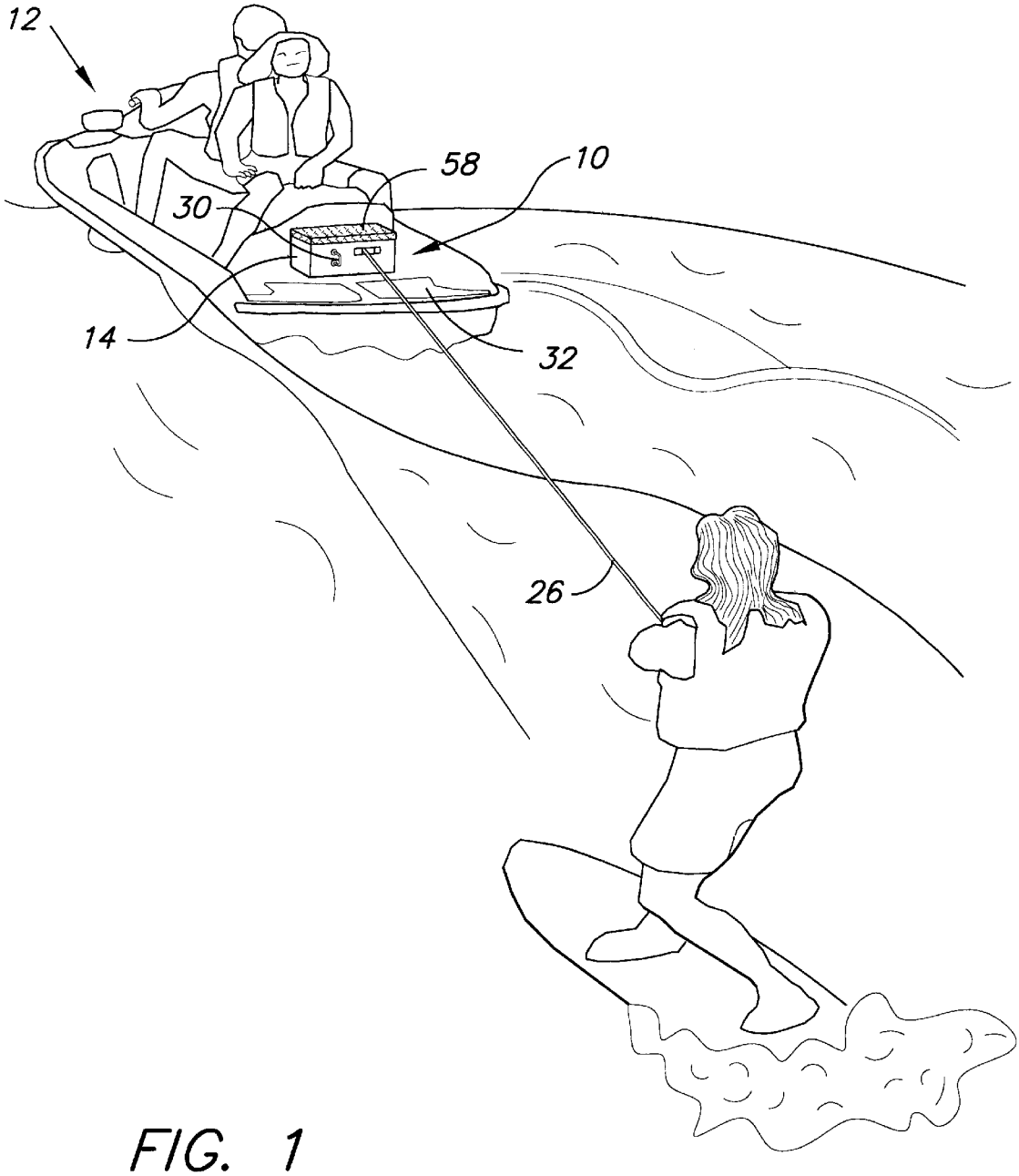
FIG. 1 is an environmental view of a motorized retractable ski tow rope according to the present invention, being used to tow a water skier.

Referring to FIGS. 1, 3, 4, 5, and 6, the present invention is directed to a water ski tow rope retrieval and payout system 10 for attachment to a watercraft 12. The water ski tow rope retrieval and payout system 10 includes a housing 14 which has an open top 16 and a rearward opening slot 18. The housing 14 is adapted for attachment to the watercraft 12. A reel support frame 20 is supported within the housing 14. A reel or spool 22 is rotatably supported by the reel support frame 20. Rotatable support for the reel 22 is provided by a shaft 24 which is supported by journal bearings in the lateral walls of the reel support frame 20. Thus the reel 22 is capable of rotation about the longitudinal axis of the shaft 24 which is coincident with the axis of rotation of the reel 22.

The reel 22 is in the form of a roughly cylindrical drum having a flange at either one of its ends. A quantity of rope 26 is wound around the reel 22 and extends through the slot 18. The rope 26 terminates in a snap hook 28 which has a pivoting latch. The snap hook 28 allows a handle for grasping by a water skier to be removably attached to the rope 26. Also, the snap hook 28 allows the rope 26 to be used for towing other objects such as another disabled watercraft. In addition, the snap hook 28 can be hooked to the U-shaped bar 30 or some other structure of the watercraft to secure the end of the rope 26 when the water ski tow rope retrieval and payout system 10 is not in use.

Figure 4:
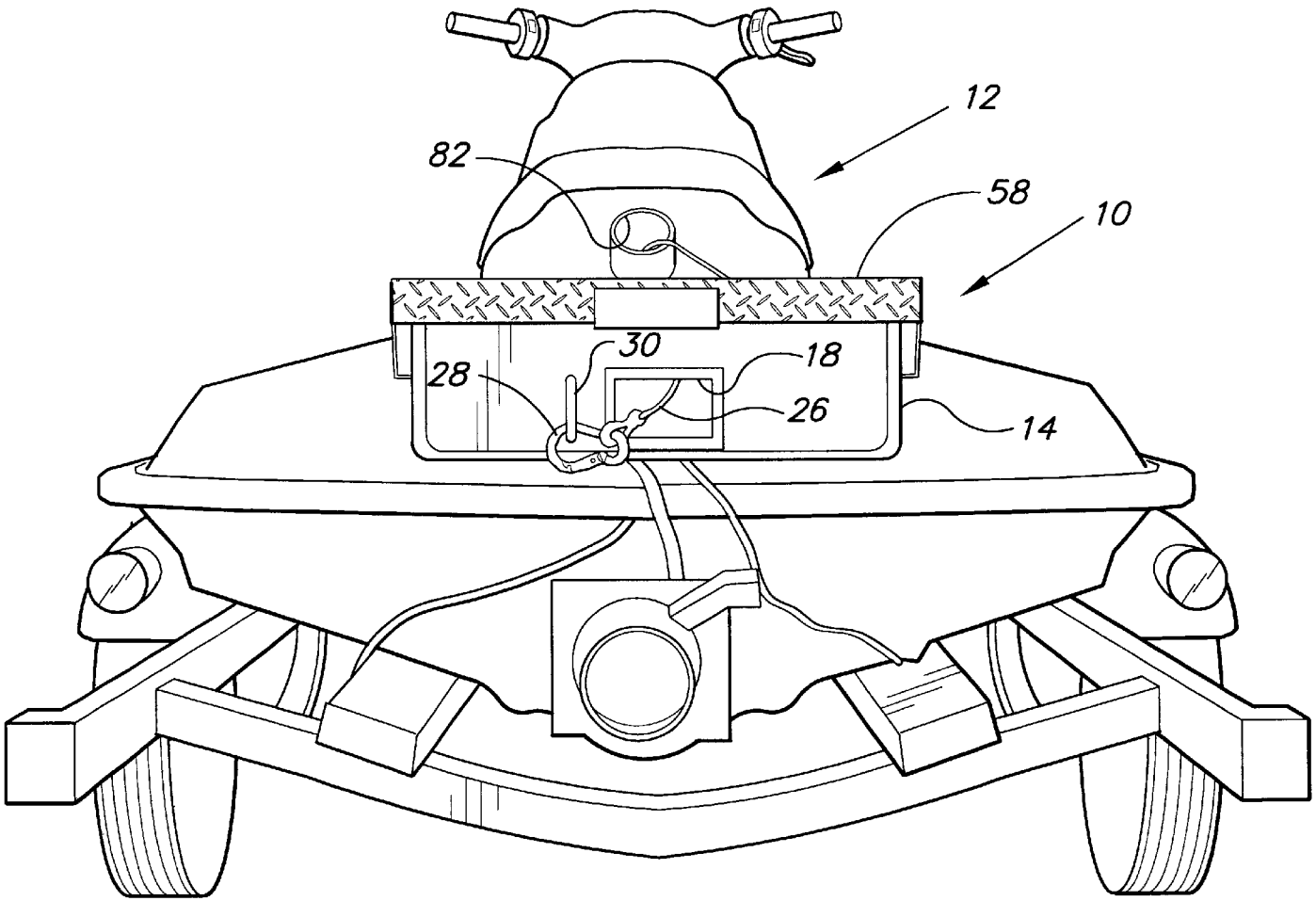
FIG. 4 is an environmental view of the motorized retractable ski tow rope of the present invention mounted to the rear deck of a personal watercraft.
Figure 5:
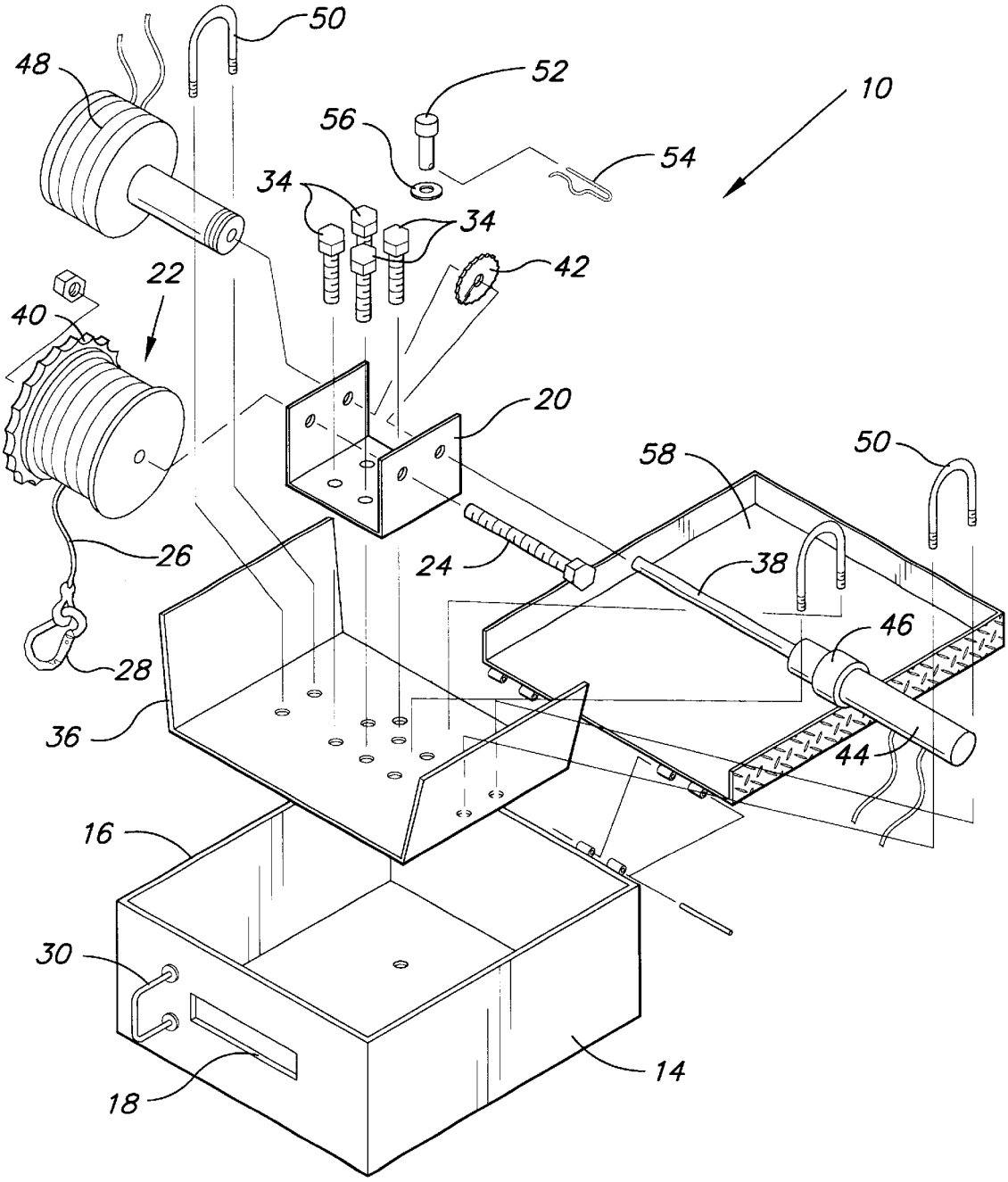
FIG. 5 is a exploded view of the motorized retractable ski tow rope of the present invention.
Figure 6:
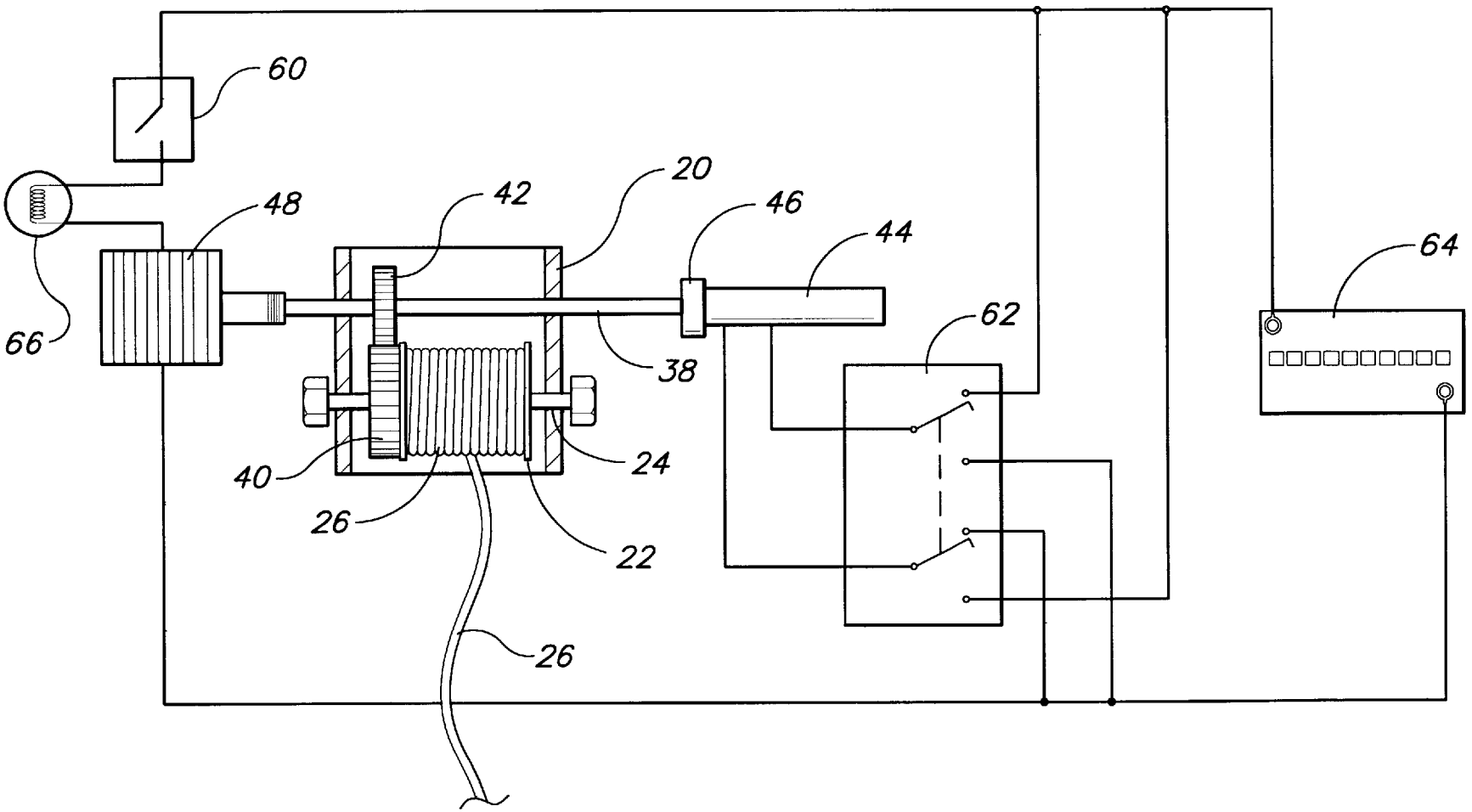
FIG. 6 is a diagrammatic view of the motorized retractable ski tow rope of the present invention having hard wired controls.

In the embodiment of FIGS. 1 and 4, the water ski tow rope retrieval and payout system 10 is mounted to the rearmost portion 32 of the deck of the watercraft 12. To mount the housing 14 to the deck of the water craft, the bolts 34 used to secure the frame 20 to the housing 14 must project beyond the bottom of the housing 14. For this reason, the frame 20 is first bolted to a cradle 36. The cradle 36 is then attached to the housing 14 by bolts (not shown) passing through the lateral walls of the cradle 36 and the lateral walls of the housing 14. The cradle 36 is mounted inside the housing 14 such that the bottom of the cradle 36 is spaced apart from the bottom of the housing 14 in order to provide clearance for the nuts (not shown) used for securing the bolts 34 in place.

A shaft 38 is rotatably supported by the reel support frame 20. Again, the shaft 38 is supported by journal bearings in the lateral walls of the reel support frame 20. Thus the shaft 38 is capable of rotation about its own longitudinal axis. The shaft 38 has a first end and a second end. The shaft 38 is rotatably supported with the longitudinal axis thereof parallel to the axis of rotation of the reel 22.

A first gear wheel 40 is rotatably supported by the reel support frame 20. The first gear wheel 40 has an axis of rotation which is coincident with the axis of rotation of the reel 22. The first gear wheel 40 is fixed relative to the reel 22 such that the first gear wheel 40 and the reel 22 rotate as a unit. Fixing the first gear wheel 40 relative to the reel 22 can, for example, be accomplished by having both the first gear wheel 40 and the reel 22 keyed or splined to the shaft 24.

A second gear wheel 42 is fixed to the shaft 38, concentric with the longitudinal axis of the shaft 38. The second gear wheel 42 is fixed to the shaft 38 such that the gear wheel 42 and the shaft 38 rotate together as a unit. Again, this can be accomplished by having the gear wheel 42 keyed or splined to the shaft 38. The second gear wheel 42 is in mesh with the first gear wheel 40 such that rotation of the shaft 38 causes the rotation of the reel 22.

A twelve volt bipolar electric motor 44 is also supported within the housing 14. The electric motor 44 is coupled to a portion of the shaft 38 adjacent to and including the first end of said shaft 38. The motor 44 selectively powers the shaft 38 to move the shaft 38 rotationally and thereby power the rotation of the reel 22. The electric motor 44 is bipolar, which means that by reversing the polarity of the power supplied to the motor 44 the direction of rotation of the shaft 38 can be reversed. Thus, the motor 44 can be selectively operated in a first rotational direction and in a second rotational direction in order to selectively payout and retrieve the tow rope 26, respectively. A speed reduction gearbox 46 may be provided intermediate the electric motor 44 and the shaft 38 in order to reduce the amount of output torque required from the electric motor 44 to effectively rotate the reel 22. Thus, the gearbox 46 allows the motor 44 to be small enough for practical application to personal watercraft.

A solenoid operated clutch 48 is also supported within the housing 14. The solenoid operated clutch 48 is coupled to a portion of the shaft 38 adjacent to and including the second end of the shaft 38. The solenoid operated clutch 48 has an outer housing which is fixed to the housing 14 in a manner that will be described later. The solenoid operated clutch 48 has two sets of plates in its housing. The first set of plates are splined to and rotationally fixed relative to the housing of the clutch 48. The second set of plates are interleaved with the first set of plates. Also, the second set of plates are splined to and rotate with the shaft 38. A spring biased plunger normally biases the two sets of plates into frictional engagement with one another, thus preventing the rotation of the shaft 38. A solenoid acts to disengage the plunger from the two sets of plates, when the solenoid is energized. Thus when the solenoid is energized, the two sets of plates are no longer in frictional engagement with one another and the shaft 38 can be rotated. The construction of the clutch 48 is well known and therefore the construction of the clutch 48 is not shown herein in detail. Consequently, the solenoid operated clutch 48 can be thought of as being in a disengaged condition when energized, thereby allowing rotation of the shaft 38. The solenoid operated clutch 48 can be thought of as being in an engaged condition when not energized. The solenoid operated clutch 48 prevents rotation of the shaft 38 when the solenoid operated clutch 48 is in the engaged condition. It should be noted that other types of well known brakes or clutches may also be used in the present invention, as long as the brake or clutch can be electrically controlled to selective engage or disengage from the shaft 38.

The gearbox 46 is secured to the motor 44. The motor 44 and the clutch 48 are secured to the cradle 36 by U-bolts 50. The U-bolts 50 are secured in place by nuts (not shown) Again, the space between the bottom of the cradle 36 and the bottom of the housing 14 provides clearance for the nuts securing the U-bolts 50 in place. A pin 52 is placed through the frame 20, the cradle 36, the bottom of the housing 14, and the deck of the watercraft 12 to secure the water ski tow rope retrieval and payout system 10 to the watercraft 12. A cotter pin 54 is used to secure the pin 52 in place. A spacer washer 56 is placed between the deck of the watercraft and the cotter pin 54 to prevent any play in the pin 52 and or the housing 14.

A hinged lid 58 acts as a closure for the housing 14. The hinged lid 58 is provided with a non-slip upper surface so that the lid 58 may be used as a step when the lid is in the closed position.

The water ski tow rope retrieval and payout system 10 is controlled by two switches 60 and 62 installed on the control panel of the watercraft 12. The switch 60 is a two position switch and, when in the closed position, allows current from the battery 64 to energize, and thus disengage, the solenoid operated clutch 48. The battery 64 is preferably the watercraft's own battery. When the switch 60 is closed, an indicator light 66 is also lit to alert the operator to the fact that the clutch 48 is disengaged and that the reel 22 can rotate.

The switch 62 is a three position switch. In the first position the switch 62 allows current with a first polarity to be supplied to the motor 44 from the battery 64. When current is supplied with the first polarity, the motor 44 may power the reel 22 to pay out the rope 26. In the second position, the switch 62 is open and no current is supplied to the motor 44. The third position, the switch 62 allows current with a second polarity to be supplied to the motor 44 from the battery 64. When current is supplied with the second polarity, the motor 44 may power the reel 22 to retrieve the rope 26.

In operation, the operator normally has the switches 60 and 62 in the open position. In this condition, the length of the rope 26 extending outside the housing 14 is fixed and the watercraft can be used to tow a water skier in the normal manner. To pay out more rope 26, the switch 60 is first closed to disengage the clutch 48 and then the switch 62 is moved to the first position. Once the desired length of rope has been paid out, the switches 62 and 60 are moved to their open positions in that order. To retrieve the rope 26, the switch 60 is first closed to disengage the clutch 48 and then the switch 62 is moved to the second position. Once the desired length of rope has been retrieved, the switches 62 and 60 are again moved to their open positions in that order.

Figure 7:
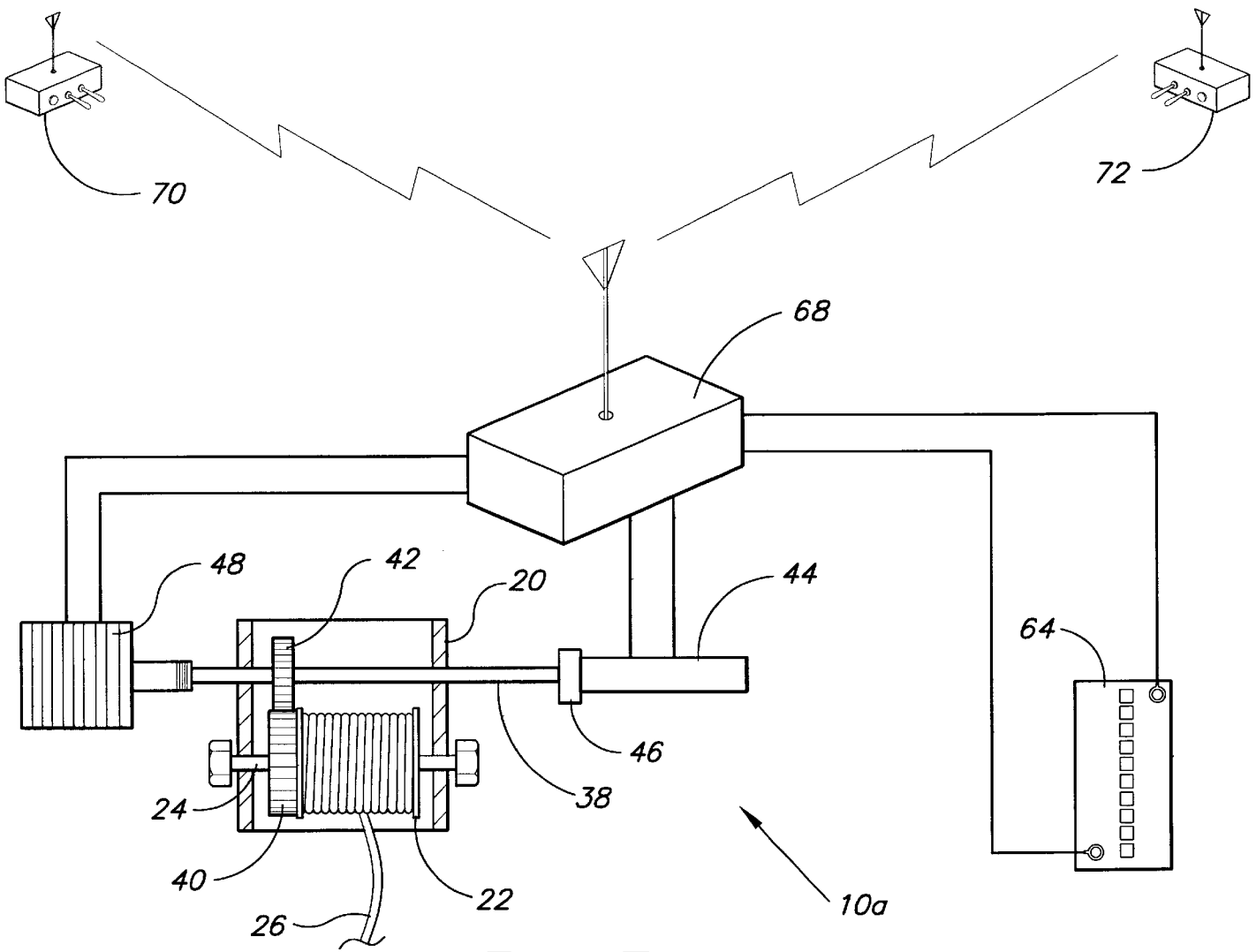
FIG. 7 is a diagrammatic view of the motorized retractable ski tow rope of the present invention having provision for remote control.

Referring to FIG. 7, another embodiment 10*a* of the water ski tow rope retrieval and payout system can be seen. The embodiment 10*a* uses radio remote control to allow both the watercraft operator and the water skier to control the length of the rope 26 extending outside the housing 14. The system 10*a* includes a receiver/control unit 68 which is mounted in the watercraft. The control unit 68 contains a circuit similar to that shown in FIG. 6, except that the switches 60 and 62 are replaced by similar switches which can be electrically actuated in response to radio signals received by the control unit 68. Two radio transmitters 70 and 72 would preferably be provided for the skier and the watercraft operator, respectively. The transmitters 70 and 72 are internally similar and have switches and indicator lights which provide functionality similar to the switches 60 and 62 and the indicator light 66.

The transmitters 70 and 72 are diagrammatically depicted in FIG. 7. Preferably, the transmitter 70 resembles the type of transmitter used to control an automotive theft deterrent system in size and appearance. The transmitter 72 may resemble the type of transmitter used to control an automotive theft deterrent system in size and appearance, or the transmitter 72 may be integrated into the control panel of the watercraft in a manner similar to that shown in FIG. 3. The circuits for transmitting and receiving radio control signals over multiple channels are well known and are therefore not described herein in detail.

Figure 2A:
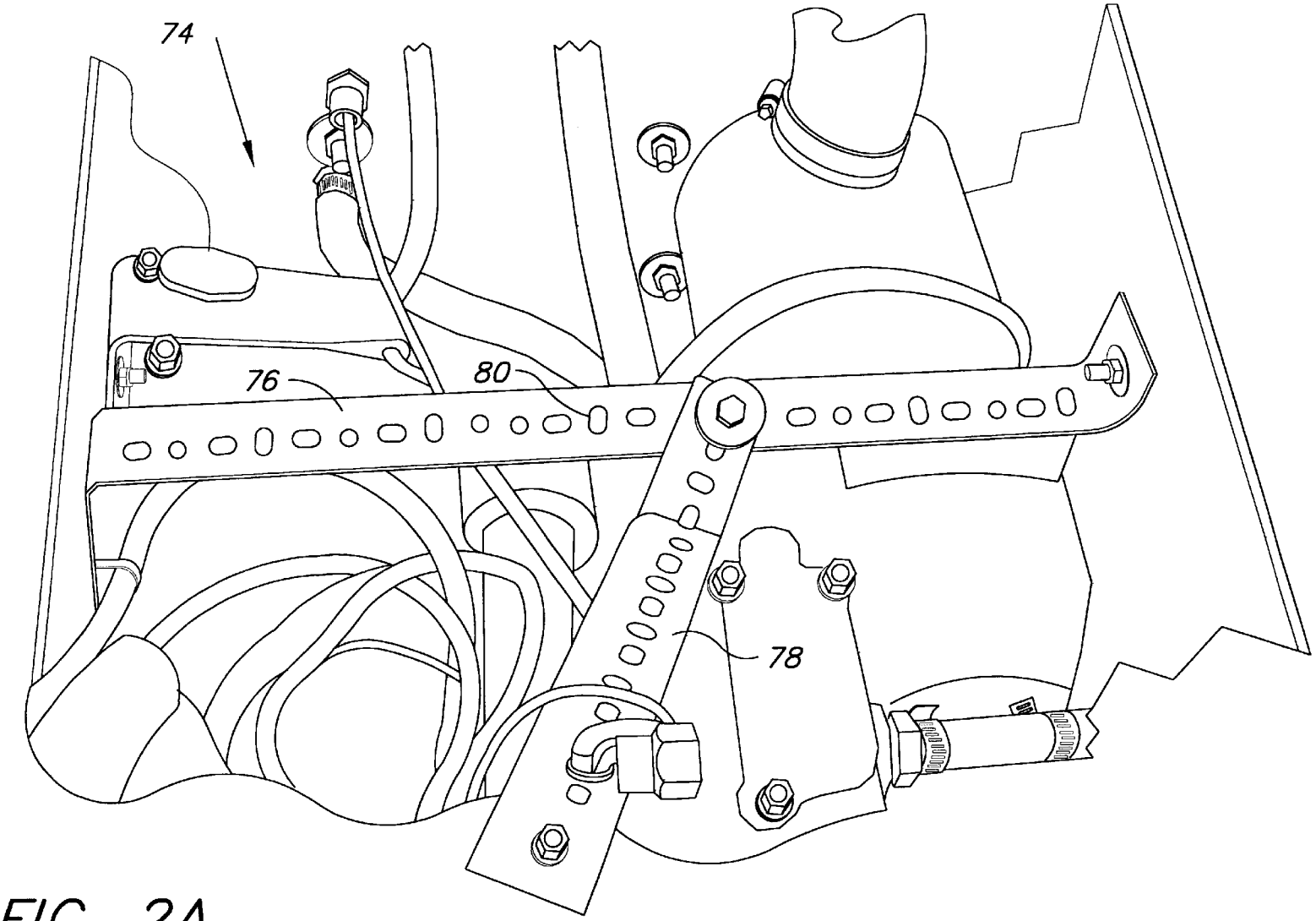
FIG. 2A is an environmental view of the mounting hardware used to mount the motorized retractable ski tow rope of the present invention inside the engine compartment of a personal watercraft.
Figure 2B:
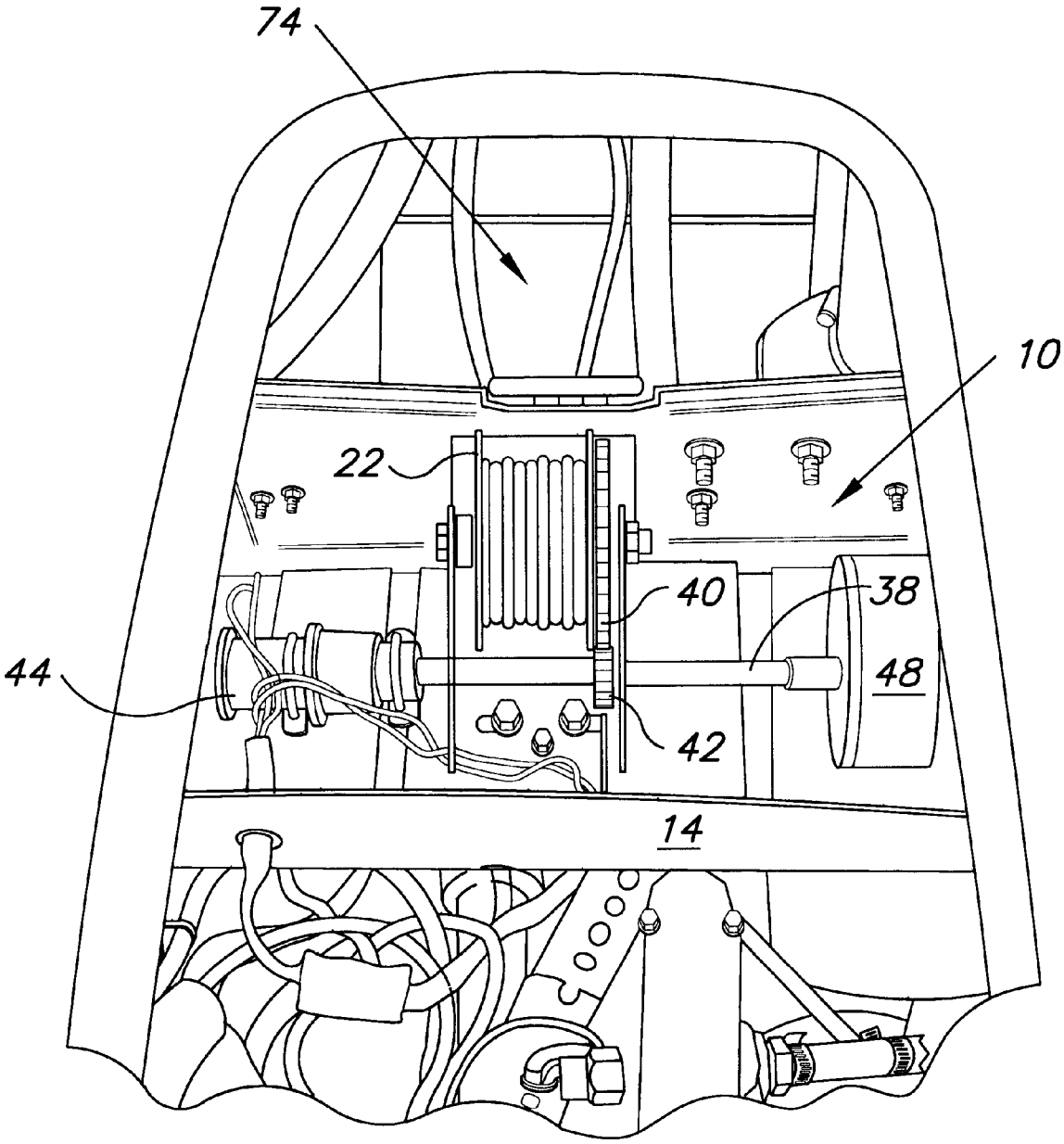
FIG. 2B is an environmental view of the motorized retractable ski tow rope of the present invention mounted inside the engine compartment of a personal watercraft.
Figure 2C:
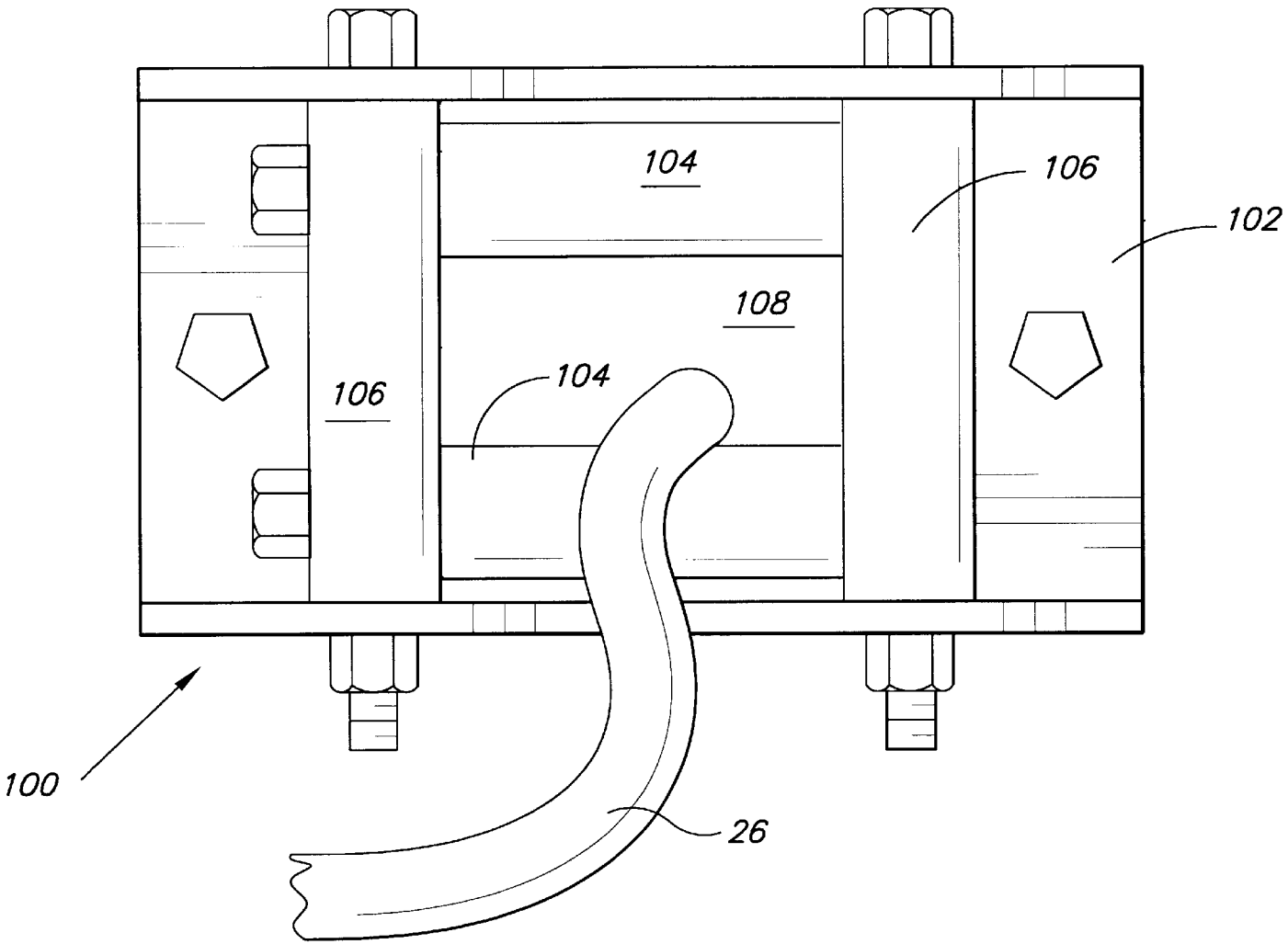
FIG. 2C is a diagrammatic view of the rear access passage and roller fairlead that guides the rope when the unit is mounted internally.
Figure 3:
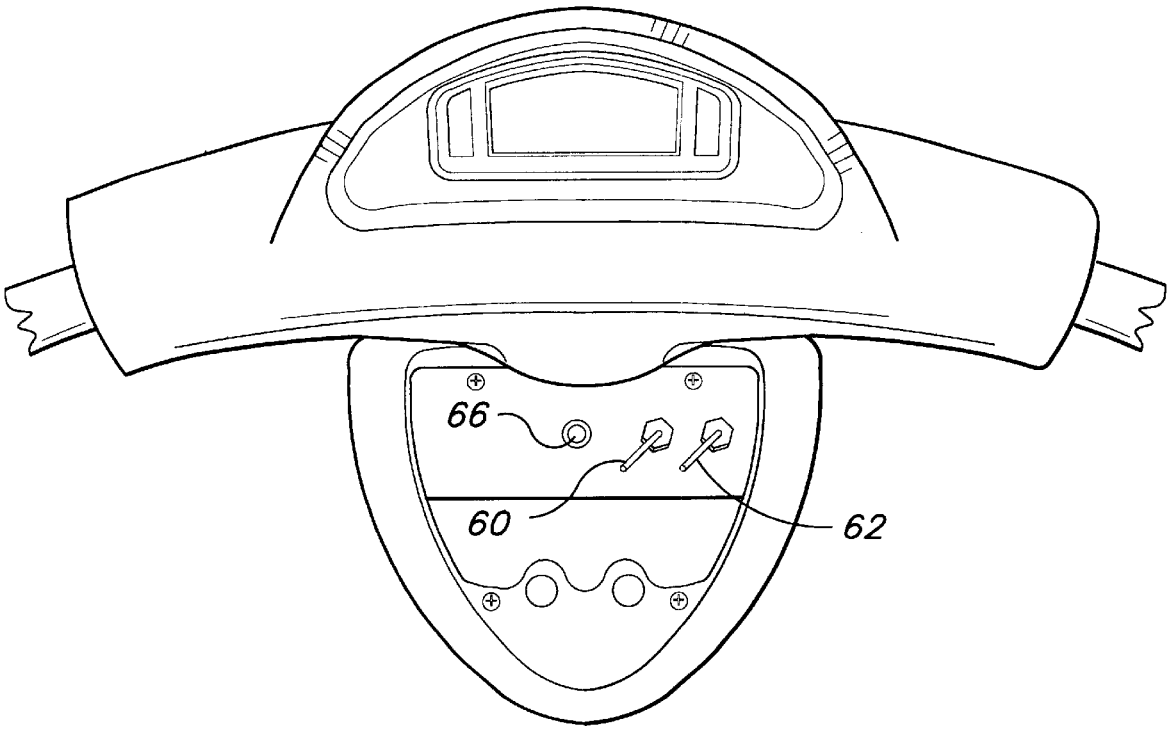
FIG. 3 is an environmental view of the control switches and the indicator light for the motorized retractable ski tow rope-of the present invention, as provided on the control panel of a personal watercraft.

Referring to FIGS. 2A, 2B, and 4, an alternative mode of mounting the water ski tow rope retrieval and payout system 10 to a personal watercraft 12 can be seen. In FIGS. 2A and 2B, the system 10 is mounted inside the engine compartment 74. The lid 58 is removed as it is no longer necessary. Mounting hardware including a mounting bar 76 and a brace member 78 are first installed inside the engine compartment 74. The mounting bar 76 is bolted to the sides of the engine compartment. The brace member 78 is bolted to the mounting bar 76 at one end and to the engine block at the other end. The mounting bar 76 has at least one hole 80 to allow the system 10 to be secured to the mounting bar 76 using the pin 52 in the manner that has already been described with reference to the mounting of the system 10 to the deck of the watercraft. The rope 26 is routed to the exterior of the engine compartment through a passage 82 provided at the rear of the engine compartment. FIG. 2C shows a rear access passage and roller fairlead 100 that can be used to guide the ski rope 26 when the unit is mounted in the engine compartment. The passage and fairlead 100 includes a rectangular frame 102 bolted around an opening in a wall of the engine compartment. Mounted on the frame is a first pair of parallel rollers 104 and a second pair 106 of parallel rollers normal to the first pair 104, the rollers 104 and 106 defining a slot 108 through which the rope 26 pays out of the engine compartment.

It is to be understood that the present invention is not limited solely to the embodiments described above, but encompasses any and all embodiments within the scope of the following claims.

I claim:

1. A water ski tow rope retrieval and payout system for attachment to a watercraft, the water ski tow rope retrieval and payout system comprising:

a housing having an open top and a rearward opening slot, said housing being adapted for attachment to the watercraft;

a reel support frame supported within said housing;

a reel rotatably supported by said reel support frame, said reel being capable of rotation about an axis of rotation;

a shaft rotatably supported by said reel support frame, said shaft having a first end, a second end and a longitudinal axis, said shaft being rotatably supported with said longitudinal axis thereof parallel to said axis of rotation of said reel;

a first gear wheel rotatably supported by said reel support frame, said first gear wheel having an axis of rotation which is coincident with said axis of rotation of said reel, said first gear wheel being fixed relative to said reel such that said first gear wheel and said reel rotate as a unit;

a second gear wheel fixed to said shaft concentric with said longitudinal axis of said shaft, said second gear wheel being in mesh with said first gear wheel such that rotation of said shaft causes the rotation of said reel;

an electric motor supported within said housing, said electric motor being coupled to a portion of said shaft adjacent to and including said first end of said shaft to selectively power said shaft to move rotationally; and a solenoid operated clutch supported by said housing, said solenoid operated clutch being coupled to a portion of said shaft adjacent to and including said second end of said shaft, said solenoid operated clutch being in a disengaged condition when energized to allow rotation of said shaft, said solenoid operated clutch being in an engaged condition when not energized, said solenoid operated clutch preventing rotation of said shaft when said solenoid operated clutch is in said engaged condition.

2. The water ski tow rope retrieval and payout system according to claim 1, further comprising:

a speed reduction gearbox, said electric motor being coupled to said shaft via said speed reduction gearbox, whereby less torque is required from the electric motor to rotate said reel.

3. The water ski tow rope retrieval and payout system according to claim 1, wherein said electric motor can be selectively operated in a first and a second rotational direction in order to selectively payout and retrieve a tow rope, respectively.

4. The water ski tow rope retrieval and payout system according to claim 1, further comprising:

a radio receiver communicating with said electric motor and said solenoid operated clutch; and a radio transmitter adapted for transmitting user inputs to said radio receiver, whereby a user may operate the water ski tow rope retrieval and payout system by remote control.

* * * * *